United States Patent [19]

Grandpierre

[11] Patent Number: 4,522,527

[45] Date of Patent: Jun. 11, 1985

[54] TUBULAR-TYPE SCAFFOLDINGS, METHOD FOR ASSEMBLING THEM AND TO THE HORIZONTAL TRANSOMS INCORPORATED THEREIN

[75] Inventor: Cyril M. Grandpierre, La Ciotat, France

[73] Assignee: Entrepose Travaux Publics, Paris, France

[21] Appl. No.: 418,191

[22] Filed: Sep. 14, 1982

[30] Foreign Application Priority Data

Sep. 24, 1981 [FR] France ..... 81 18182

[51] Int. Cl.[3] ..... E04G 7/00

[52] U.S. Cl. ..... 403/49; 403/14; 403/246; 182/178; 29/428

[58] Field of Search ..... 403/49, 395, 398, 399, 403/79, 157, 246, 14; 182/178, 179; 29/428

[56] References Cited

U.S. PATENT DOCUMENTS

| | | | |
|---|---|---|---|
| 3,300,236 | 1/1967 | Sauls | 403/49 |
| 3,817,641 | 6/1974 | Steele et al. | 403/256 |
| 3,879,143 | 4/1975 | Gostling | 403/49 |
| 3,880,533 | 4/1975 | Gostling | 403/49 X |
| 4,044,523 | 8/1977 | Layher | 403/49 X |
| 4,083,640 | 4/1978 | Lovering | 403/246 |
| 4,180,342 | 12/1979 | Layher | 403/49 X |
| 4,348,128 | 9/1982 | Gostling | 403/49 |
| 4,394,095 | 7/1983 | Layher | 403/49 |
| 4,405,254 | 9/1983 | Tooley | 403/49 X |

FOREIGN PATENT DOCUMENTS

| | | |
|---|---|---|
| 2288199 | 5/1976 | France . |
| 1528983 | 7/1976 | United Kingdom . |

*Primary Examiner*—Cornelius J. Husar
*Assistant Examiner*—Todd G. Williams
*Attorney, Agent, or Firm*—Bucknam and Archer

[57] ABSTRACT

The invention relates to tubular-type scaffoldings, to a method for assembling them and to the horizontal transoms incorporated therein. A scaffolding according to the invention comprises vertical elements bearing sockets on each of which may be fixed one end of a horizontal transom bearing a fork and a conical pin prisoner therein. Near its end, the pin comprises a protruding pivot. At rest, the pin occupies a substantially horizontal position and the upper edge of the socket abuts slightly to the rear of the pivot and causes the pin to pivot to vertical position. One application of the invention is the erection of scaffoldings for the construction of buildings, ships or reservoirs.

12 Claims, 13 Drawing Figures

TUBULAR-TYPE SCAFFOLDINGS, METHOD FOR ASSEMBLING THEM AND TO THE HORIZONTAL TRANSOMS INCORPORATED THEREIN

FIELD OF THE INVENTION

The present invention relates to tubular-type scaffoldings, to a method for assembly thereof and to the horizontal transoms incorporated in such scaffoldings.

The technical sector of the invention is that of the construction of rapidly assembled and dismantled tubular-type scaffoldings.

Tubular-type scaffoldings are scaffoldings composed of vertical elements connected together by transoms or horizontal crosspieces and possibly by oblique wind braces.

The vertical elements, transoms and wind braces are generally tubes, hence the current name of tubular scaffolding. It is specified that this name is not limiting in character and that the vertical, horizontal or oblique elements may be other than tubes, for example angles or girders in section form.

The vertical elements may also be constituted by a vertical wall, for example a metal reservoir wall or a ship's hull on which the horizontal transoms are fixed.

Rapidly assembled and dismantled tubular-type scaffoldings are well known and are currently used as scaffolding in the construction of buildings, ships, reservoirs, for supporting frameworks or for constructing easily dismountable light structures, etc . . . .

DESCRIPTION OF THE PRIOR ART

Tubular-type scaffoldings are known in which the vertical elements are equipped with hooking elements fixed at determined levels and the horizontal transoms bear at at least one of their ends an assembly piece which is rigidly assembled with a hooking element by a wedge-shaped pin.

U.S. Pat. No. 3,817,641 to KWIKFORM Limited describes such scaffoldings in which the vertical elements comprise vertical sockets and the horizontal transoms are equipped at their two ends with a spigot member having two arms which engage on a socket and which comprise slots in which a conical wedge member is manually engaged.

French Pat. No. 2 288 199 (75 31319) to E. LAYHER describes tubular scaffoldings comprising vertical elements which are equipped with horizontal flanges bearing openings and horizontal elements which bear, at their ends, shoes which are provided with a horizontal slot which engages on a flange and with two openings in which a conical pin is manually engaged.

All known tubular-type scaffoldings comprising a fork-shaped assembly piece and a pin which is driven through slots in the fork present the drawback that a workman must have access to each point of assembly to place the pin in position by hand. This operation requires time and, in addition, it may be dangerous since, during this operation, the horizontal transom is only engaged on a socket without being connected thereto, and the scaffolding is not rigid.

A deformation of the scaffolding risks causing the transom to fall and this may injure the workman or even knock him down.

SUMMARY OF THE INVENTION

It is a first object of the present invention to provide improved scaffoldings wherein the introduction of the pin does not require a workman to have access to each point of connection, but can be automatically obtained by a slight relative displacement in the vertical direction of a transom after the forks located at the end thereof have been engaged around the sockets of the vertical elements.

It is a further object of the present invention to procure scaffoldings which comprise assembly sockets enabling a horizontal transom to be fixed in an oblique direction with respect to the vertical plane of symmetry of the sockets, which makes it possible in particular to place horizontal transoms not perpendicular to a flat vertical support in the event of the sockets being fixed to such a support, for example to the wall of a reservoir or to a ship's hull.

It is a further object of the invention to provide scaffoldings in which the sockets fixed to the vertical elements enable oblique wind braces to be fixed.

Yet a further object of the invention is to provide scaffoldings comprising pins which may be dismantled with the aid of cables or poles without requiring the effective presence of a workman whose job is to drive in the pins locally.

A scaffolding according to the invention is a scaffolding of tubular type which is composed of vertical elements equipped with hollow sockets and with horizontal transoms comprising, at at least one of their two ends, an assembly piece in the form of a fork which comprises a vertical wall and two horizontal flanges each comprising a slot, which fork bears a conical pin imprisoned therein which is engaged through the slot in the upper flange and which occupies a substantially horizontal rest position.

The objects of the invention are attained by means of scaffoldings in which each pin comprises a protruding pivot which is located near the narrow end of the pin and which abuts against the lower face of said upper flange and said pin and/or said fork further comprise means for positioning the pin in rest position so that the upper edge of said socket abuts slightly to the rear of said pivot when said fork is engaged on one of said sockets and in abutment thereagainst and means for guiding the descent by gravity of said pin.

The method for assembly the scaffoldings according to the invention comprises the following operations: A fork bearing a substantially horizontal pin is engaged on a socket until the vertical wall of the fork abuts against the socket then a relative vertical displacement is made of the transom bearing the fork with respect to the socket which brings the upper edge of the socket in abutment against the lower edge of the pin, slightly to the rear of said pivot and which causes the pin to pivot to the vertical and descend by gravity inside said socket, engaging in the slot in the lower flange.

DESCRIPTION OF THE PREFERRED EMBODIMENT

According to a preferred embodiment, the lateral faces of the sockets comprise at least one hole for fixing oblique wind braces. This hole is preferably extended by a lateral notch.

The widest end of each pin advantageously bears a hole or a slot enabling the pin to be hooked to lift it from a distance.

The invention results in novel tubular-type scaffoldings which are rapid to assemble and dismantle.

An essential advantage of the scaffoldings according to the invention lies in the fact that the pins for assembling the horizontal transoms on the vertical elements are placed in position without any workman having to have access to the points of assembly to position the pins by hand. This positioning is obtained simply by a relative vertical movement of the transom with respect to the fixing sockets. The general, the mere weight of the transoms suffices to cause the pins to pivot. This firstly results in a considerable saving of time and, in addition, accidents during erection of scaffoldings are reduced. Finally, it becomes possible to position and remove horizontal transoms at places which are of difficult access, by offering them suspended from a cable or by guiding them with poles for engage the forks on the sockets.

This result was obtained by modifications of the known pins and assembly pieces enabling the pins to pivot and drop into their housing without any manual intervention on the pins.

In particular, the devices for positioning the pins at rest which cause the upper edge of the sockets to abut slightly to the rear of the pivot of the pin are essential for correct functioning as well as the devices which guide the descent of the pin by gravity.

Of course, once the whole of the scaffolding according to the invention has been erected, a workman can drive in each pin with a hammer but he can do this in complete safety as the whole scaffolding is rigid and he can work rapidly, passing directly from one pin to the following without any intermediate displacement.

This pin blocking operation may be eliminated by vibrating the whole scaffolding, which suffices to block the pins.

The scaffoldings according to the invention make it possible to fix horizontal transoms as brackets on a vertical wall. In this application, thanks to the shape of the sockets, they enable brackets to be fixed perpendicularly, obliquely or parallel to the wall.

The scaffoldings according to the invention enable oblique wind braces to be fixed directly on the sockets.

DESCRIPTION OF THE DRAWINGS

The invention will be readily understood on reading the following description with reference to the accompanying drawings, in which:

Referring now to the drawings, FIGS. 1 and 2 show an assembly between a vertical element 1 and one end of a horizontal transom 2 of a scaffolding.

Figure 2:
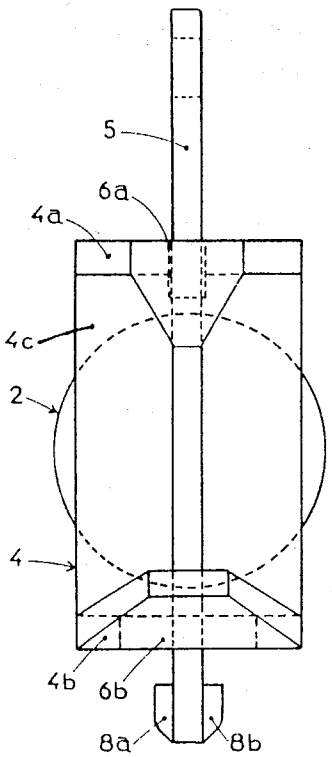
FIG. 2 is a view from the left of the end of the tramsom of FIG. 1.

The vertical elements 1 bear hooking elements 3 in the form of hollow sockets. The sockets 3 are fixed to the vertical elements at determined levels. The sockets 3 are constituted for example by a steel band which is curved and whose two ends are welded to the vertical element 1. At least one of the ends of the horizontal transoms 2 is provided with a hooking element 4 in the form of a fork or stirrup in U form, having two horizontal flanges 4*a*, 4*b* connected together by a vertical wall 4*c* which is welded to one end of the transom 2. The opening of the fork 4 is greater than the height of the sockets 3, with the result that the fork may be engaged on a socket, the flanges 4*a* and 4*b* then being placed above and below the socket 3.

A fork 4 and a socket 3 are assembled in known manner by means of a wedge-shaped pin 5. To this end, the flanges 4*a* and 4*b* each comprise a slot, 6*a* and 6*b* respectively, and the pin 5 is engaged vertically through the two slots 6*a*, 6*b* and through the hollow socket 3.

The rear face of the pin, which is vertical, abuts against the inner face of the socket 3, whilst the front face of the pin abuts against the front ends of the slots 6*a* and 6*b*. By forcing the pin downwardly, the socket 3 is clamped between the pin and the vertical wall 4*c* of the fork.

Front or outer faces or ends are understood to mean the faces or ends oriented towards the outside of the transom 2.

The length of the slots 6*a*, 6*b* is determined as a function of the width and conicity of the pin 5 and as a function of the thickness of the socket 3, to allow clamping of the latter when the pin is forced downwardly.

Figure 1:
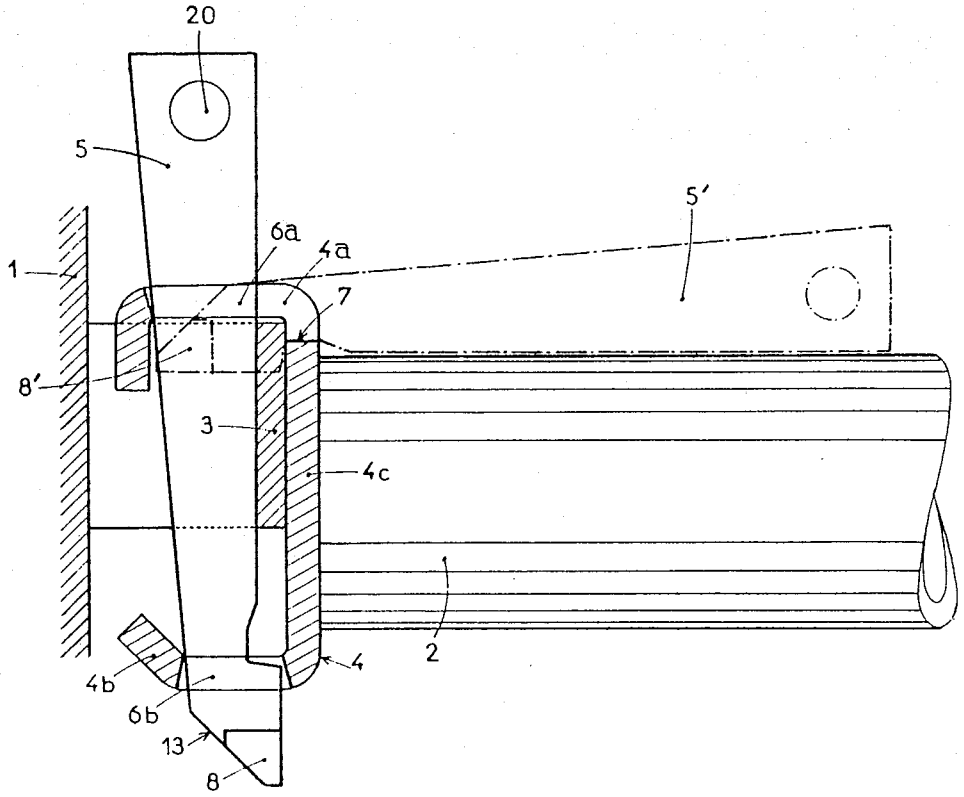
FIG. 1 is a view in elevation and in partial section of the assembly between one end of a horizontal transom and a vertical element.

FIG. 1 shows in dashed and dotted lines the position 5' occupied by the pin 5 at rest. It will be seen that the pin is then placed horizontally on the top of the transom 2 and that the pivot occupies a position 8' in abutment against the lower face of the flange 4*a*.

FIG. 1 shows that the upper flange 4*a* of the fork 4 is located above the upper face of the transom 2, that the slot 6*a* is extended rearwardly beyond the join between the flange 4*a* and the wall 4*c*, so that the rear end 7 of the slot 6*a* is situated in the vertical wall 4*c* slightly above the upper face of the transom 2. This arrangement enables the rear part of the pin 5 to rest horizontally or substantially horizontally on the top of the transom 2, whilst the front end is engaged through the slot 6*a* and is located inside the fork 4.

The pin 5 comprises, near its front end, i.e. the narrower end, a pivot 8 which is constituted for example by two projections 8*a*, 8*b* located on either side of the lateral faces of the pin.

As a variant, the pivot may be constituted by one projection only.

FIG. 2 shows that the slot 6*a* is a narrow slot whose width is only slightly greater than the thickness of the pin 5 and less than the thickness of the projections 8*a* and 8*b*.

It will also be seen that the slot 6*b* is a wide slot whose width is clearly greater than the thickness of the projections 8*a* and 8*b* which may therefore easily pass through said slot 6*b*.

It will also be seen that the length of the slot 6*b*, in the direction parallel to the axis of the transom 2, is shorter than the largest width of the pin 5. Thus, the pin is maintained in position firmly since the wider end of the pin cannot pass through the slot 6*b* and the projections 8*a*, 8*b* cannot pass through slot 6*a*.

The projections 8*a*, 8*b* perform a section function which is that of a pivot which abuts against the lower face of the upper flange 4*a* when the upper edge of the socket 3 abuts against the lower face of the pin at rest to the rear of the pivot 8.

The thrust which is then exerted on the pin causes it to pivot about pivot 8 and the pin comes into vertical position and descends by gravity inside the socket and slot 6*b*. This automatic pivoting of the pin is an essential feature of the scaffoldings according to the invention. It enables the scaffoldings to be assembled more quickly. It suffices to engage the two ends of a transom 2 on two sockets 3, then to move the transom slightly downwards for the two pins to be positioned and block the transom sufficiently to assure rigidity of the assemblings. The inherent weight of the transom generally suffices to cause automatic pivoting of the pins.

Numerous transoms may thus be assembled without the workmen having to have access each time to the ends thereof to place the pins in position by hand, hence a considerable saving of assembly time and improved safety conditions.

The assembly devices according to the invention make it possible to position, then dismantle transoms situated in positions which are inaccessible or dangerous to reach, by means of hoisting apparatus or poles, as will be seen hereinafter.

FIGS. 3 to 6 illustrate the various steps of the operation for assembly of one end of a horizontal transom 2 on a vertical element 1.

Figure 3:
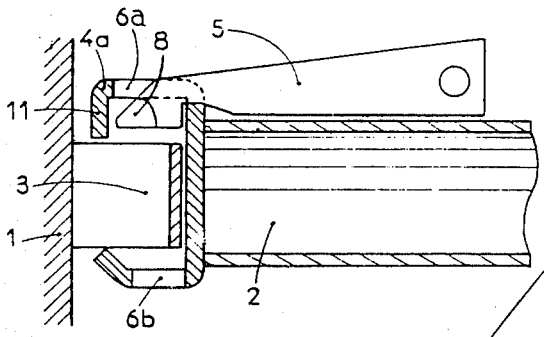
FIGS. 3 to 6 show successive stages of the assembly operation.

FIG. 3 shows the first step during which the fork 4 is engaged around a socket 3 fixed to the element 1. The narrow end of the pin bearing the pivot 8 is engaged against the lower face of the flange 4*a*.

FIG. 1 clearly shows that the inner height of the fork 4, i.e the distance between the lower face of the upper flange 4*a* and the upper face of the lower flange 4*b* is greater than the height of the socket 3, with the result that there is a clearance between the socket and the fork which allows a relative vertical displacement of one with respect to the other.

Figure 4:
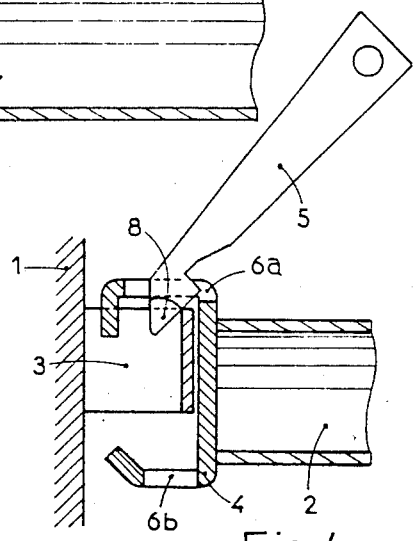

FIG. 4 shows the following step during which the transom 2 is displaced downwardly, so that the upper edge of the socket 3 abuts against the lower face of the pin 5, to the rear of pivot 8, and causes the pin to pivot into vertical position.

The fulcrum of the socket 3 against the pin is very close to pivot 8, with the result that a slight vertical displacement suffices to cause the pin to pivot.

Figure 5:
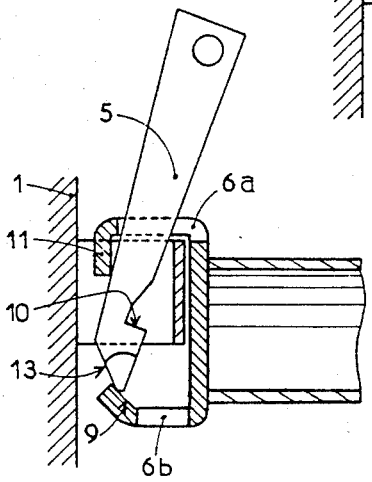

FIG. 5 shows the following step in which the pin 5 is almost vertical and descends by gravity into the hollow socket 3.

Figure 6:
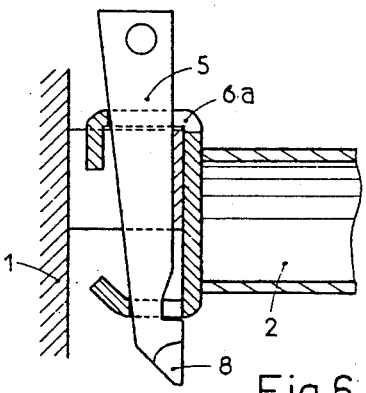

FIG. 5 shows the case of the narrow end of the pin 5 abutting against the outer end of the flange 4*b* which is bent upwardly in front of the slot 6*b*, to form an oblique ramp against which the pin slides. This ramp guides the pin which engages in the slot 6*b* and which comes into vertical position as shown in FIG. 6.

Correct functioning of an assembly according to the invention is determined by correct positioning and correct guiding of the pin which enables the latter to pivot and drop by gravity into its housing.

In addition to the bend 9 of the lower flange 4*b* forming a ramp which guides the pin towards slot 6*b*, the assembly pieces of the devices according to the invention comprise means for ensuring correct positioning of the pin 5 at rest.

A first means is a shoulder 10, visible in FIG. 5, which abuts at rest against the vertical wall 4*c* of the fork 4 and which forms a stop preventing the pin from recoiling, so that the pivot 8 is placed in front of the vertical wall of the socket 3.

In the embodiments according to FIGS. 1 to 6, the upper flange 4*a* of the fork 4 comprises a downward right-angled bend 11 which forms a stop against which abuts the front end of the pin at rest. This front stop 11 and the rear stop 10 give the pin 5 a determined rest position such that the fulcrum of the upper edge of the socket 3 against the pin is to the rear of the pivot 8 and a short distance therefrom. The bend 11 also contributes to guiding the pin during its descent as shown in FIG. 5.

In this phase, the bend 11 avoids the risk of the pin escaping from the fork 4 by passing through the open end thereof.

Figure 11:
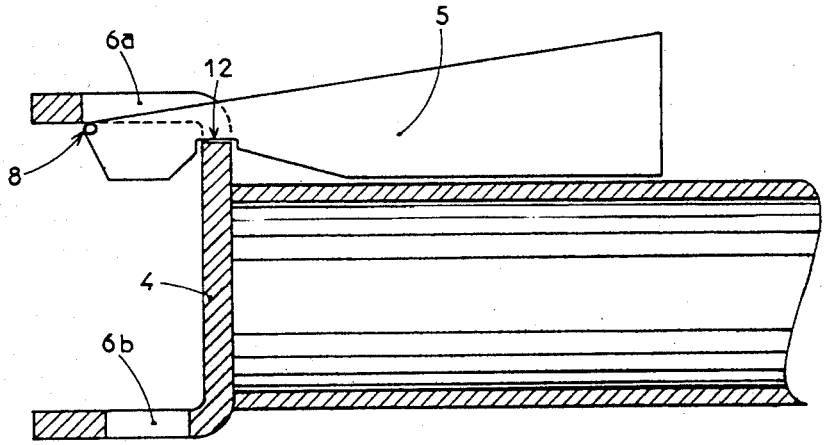

As a variant, shown in FIG. 11, the pin 5 may comprise a rectangular notch 12 whose width is slightly greater than the thickness of the vertical wall 4*c* of the fork 4 which fits on the upper edge of this wall located at the rear end of the slot 6*a*. In this case, the front and rear edges of the notch 12 perform the functions of stop for front and rear positioning of the pin 5 at rest and the bent edge 11 of the upper flange may be eliminated.

Of course, other equivalent means may be used for positioning the pin 5 at rest. For example, the rear stop 10 may be replaced by a lateral projection which abuts against the inner face of the vertical wall 4*c* of the fork 4.

Figure 12:
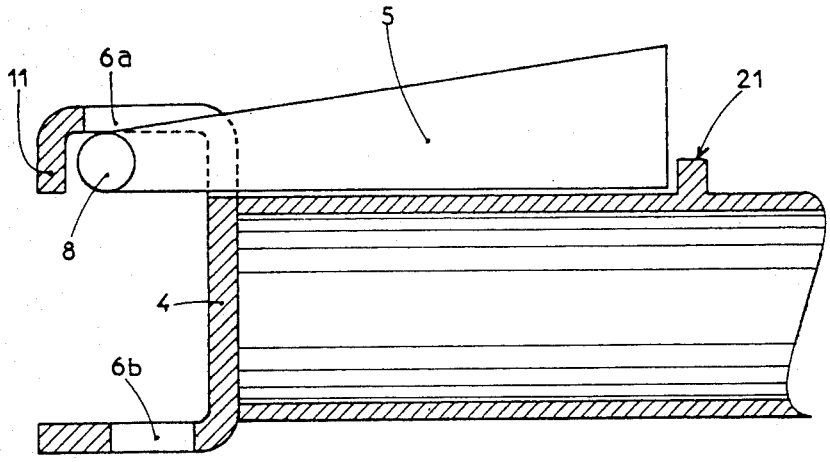
FIGS. 11 and 12 are axial sections through one end of a horizontal transom.

FIG. 12 shows another variant in which the transom 2 bears a projection 21 against which the rear end of the pin abuts in rest position.

FIGS. 1 to 6 shows an embodiment in which the narrow end of the pin has the form of a bevelled nose delimited by a ramp 13 which forms an obtuse angle with the front edge of the pin. FIG. 5 shows that the ramp 13 abuts against the ramp 9 and slides therealong to guide the pin 5 towards the slot 6*b*.

Figure 7:
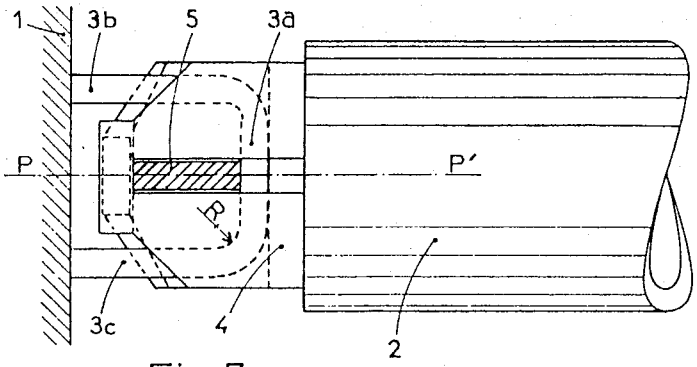

FIG. 7 is a plan view of one end of a transom 2 cottered on a socket 3 fixed to a vertical element 1. The socket 3 is in the form of a U. It comprises a face 3*a* for abutment of the pin which is a flat vertical face perpendicular to the axis of the transom 2 and two lateral faces 3*b*, 3*c* perpendicular to the bearing face 3*a*. The socket 3 therefore presents a vertical plane of symmetry PP'. The lateral faces 3*a*, 3*b* join the bearing face by curved joins 3*d*, 3*e* having a radius of curvature R.

Normally, the transom 2 is fixed in the position shown in FIG. 7 where the axis of the transom 2 is parallel to the plane PP'. This position ensures a particularly rigid assembly as the flat face 3*a* is maintained in abutment against the flat face 4*c* of the fork 4.

Figure 8:
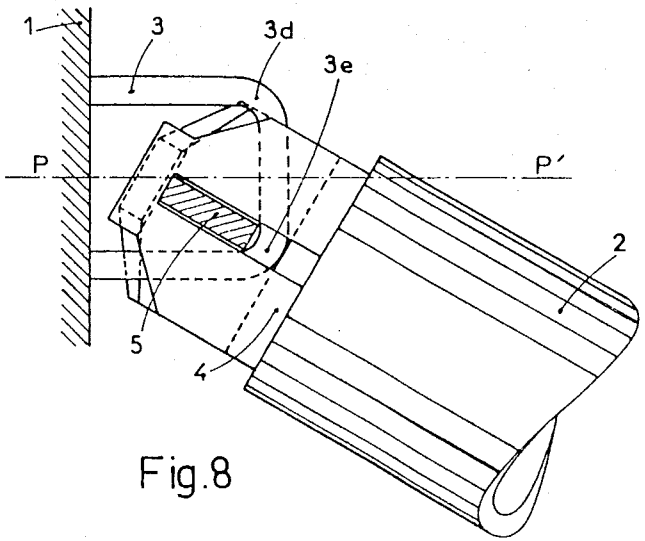
FIGS. 7 and 8 are plan views of two positions of assembly.

In the assembled position, the front ends of the fork 4 are not in contact with the vertical element 1 as shown in FIGS. 7 and 8. This arrangement enables the same forks 4 to be used whatever the tubular or flat form of the vertical elements 1.

FIG. 8 shows that the transoms 2 may be fixed to the sockets 3 in an oblique direction with respect to the plane of symmetry PP', the pin 5 then abutting against the curved inner face of a zone of join 3*d*, 3*e*.

Figure 13:
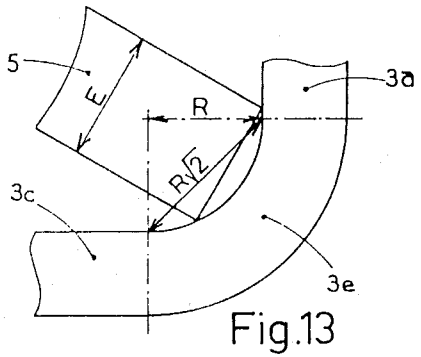
FIG. 13 is a partial horizontal section through a socket and a pin.

FIG. 13 is a view to a larger scale of a zone of join 3*e* or 3*d* having a radius of curvature R.

This Figure shows the bearing edge of the pin 5 which has a thickness E. On condition that $R\sqrt{2} \geqq E$, the pin 5 may occupy angular positions covering a sector close to 90°. For such positions to be possible, the width and the depth of the sockets 3 must in addition be sufficiently large with respect to the length of the flanges 4*a* and 4*b* for the latter not to abut against the inner faces of the socket.

On condition that the width of the lateral walls 3*a* and 3*c* of the sockets 3 is at least equal to the half-width of the fork 4, the transoms can be fixed perpendicularly to the plane of symmetry PP' by cottering them against the lateral walls 3*b* and 3*c*.

Figure 9:
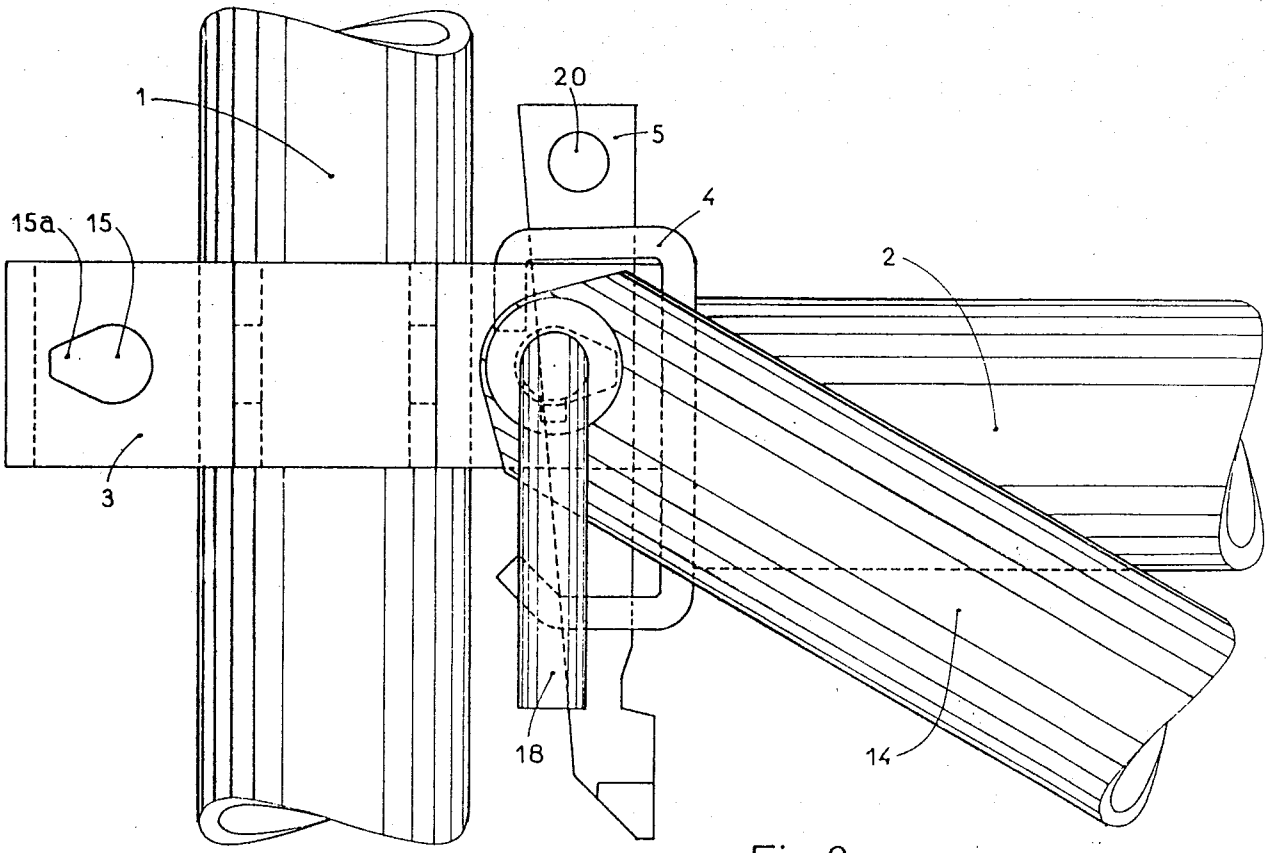
FIGS. 9 and 10 are a view in elevation and a view in plan of an assembly comprising an oblique wind brace.
Figure 10:
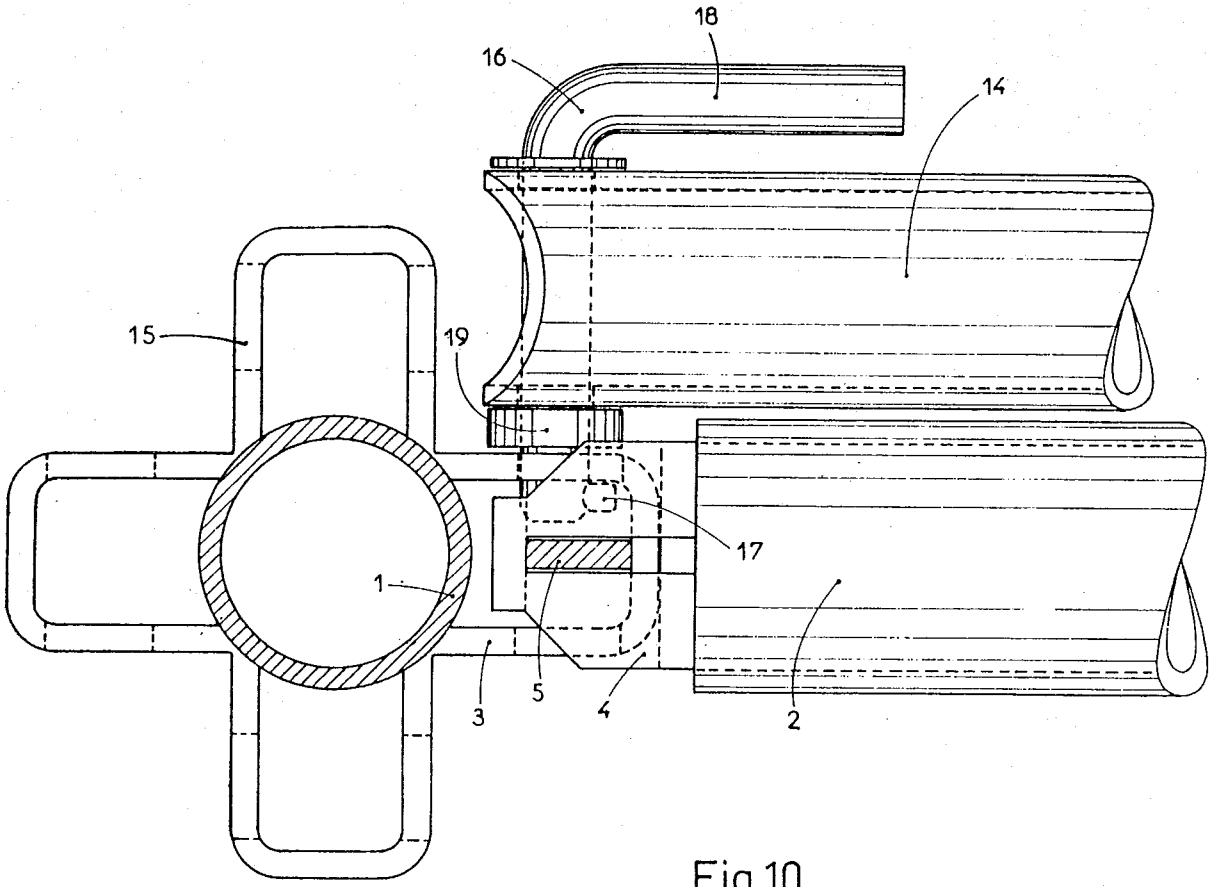

FIGS. 9 and 10 show the fixation of an oblique wind brace 14 on a point of assembly of a horizontal transom 2 with a vertical element 1.

In this example, the vertical element 1 is a tube which bears groups of four sockets 3 disposed in cruciform manner.

The lateral faces of the sockets 3 each bear a hole 15 for fixing a wind brace 14. The wind brace 14 which is for example a tube, comprises at each end two holes for fixation, aligned perpendicularly to the axis. The wind brace is fixed by means of blocking rods 16 which bear a catch 17 at one end. The holes 15 comprise a lateral notch 15*a* visible in FIG. 9 which serves for the passage of the catch 17. The rod 16 bears a bent handle 18 which makes it possible to rotate the rod to bring the catch 17 behind the inner wall of the socket 3. The rod 16 bears a stop 19.

Of course, the rods 16 may be replaced by any other equivalent fixing means.

FIGS. 1 to 9 show that the pins 5 comprise, near their wider end, one or more holes 20 which serve to hook the pin with a hook placed at the end of a cable or a hoisting apparatus to lift it from its housing and disconnect the horizontal transom from the vertical element. The holes 20 may be replaced by equivalent means such as slots. These hooking means 20 enable the pins to be removed from a distance, without any workman having to intervene locally.

What is claimed is:

1. Method of assembling a scaffolding of tubular type which is composed of vertical elements equipped with hollow sockets and of horizontal transoms comprising, at at least one of their two ends, an assembly piece in the form of a fork which comprises a vertical wall which is fixed to said one end perpendicularly to the axis of said transom and one upper horizontal flange and one lower flange each comprising a slot, which fork bears a conical pin imprisoned therein which is engaged through the slot in said upper flange and which occupies a substantially horizontal rest position, wherein said pin comprises a protruding pivot constituted by at least one projection located on a lateral face of said pin, which pivot is located near the narrow end of said pin and which is placed at rest inside said fork, and said method comprising the steps of engaging the horizontal flanges of said fork bearing a substantially horizontal pin above and below a socket, until said vertical wall of the fork abuts against said socket, then effecting a relative vertical displacement of the transom bearing the fork with respect to said socket which brings the upper edge of the socket in abutment against the lower edge of the pin, slightly to the rear of said pivot and which causes the pin to pivot to the vertical and descend by gravity inside said socket, engaging in the slot in the lower flange.

2. Scaffolding of a tubular type composed of vertical elements, hollow sockets fixed thereon and of horizontal transoms comprising, at at least one end of the horizontal transoms, a fork engaged with one of said sockets, comprising a vertical wall which is fixed to said at least one end and two horizontal flanges, the upper horizontal flange comprising an upper slot and the lower horizontal flange comprising a lower slot, said fork bearing a conical pin which is engaged through the slot in said upper flange when in a substantially horizontal rest position, wherein said pin comprises a pivot constituted by at least one projection located on a lateral face of said pin near the narrow end thereof and which abuts against the lower face of said upper horizontal flange, and wherein said pin further comprises means for positioning the pin at rest in a substantially horizontal position so that when said vertical wall of the fork abuts against said socket, the upper edge of said socket comes in abutment against the lower edge of said pin, slightly to the rear of said pivot and causes the pin to pivot to the vertical, to descend by gravity inside said socket and to engage in the slot in the lower flange.

3. The scaffolding of claim 2, wherein the pin comprises a shoulder adapted to abut against the inner face of said vertical wall and which forms a stop preventing the pin from recoiling.

4. The scaffolding of claim 3, wherein said pin comprises a rectangular notch whose width is greater than the thickness of the vertical wall of said fork and which engages on the upper edge of this wall forming the rear end of the slot in the upper flange.

5. The scaffolding of claim 4, wherein the upper flange of said fork comprises a downward right-angled bend.

6. The scaffolding of claim 5, wherein the lower flange of said fork comprises, in front of the slot for passage of the pin, a bend forming an upwardly directed oblique ramp adapted to guide the pin in its pivoting movement.

7. The scaffolding of claim 6, wherein the narrow end of the pin presents a bevelled cut-out delimited by an oblique ramp which extends the front face of the pin and which cooperates with said bend to guide the descent of the pin.

8. The scaffolding of claim 6, in which the sockets comprise a flat bearing face and two lateral faces substantially perpendicular to said support face, wherein said lateral faces join said bearing face by curved zones of join having a radius of curvature R such that $R\sqrt{2}$ is greater than or equal to the thickness E of said pins.

9. The scaffolding of claim 7, wherein said sockets comprise, on their lateral faces, at least one hole for fixing oblique wind braces.

10. The scaffolding of claim 9, wherein said holes are extended by a lateral notch.

11. The scaffolding of claim 9, wherein said pins comprise, near their wider end, a hole or slot allowing the pin to be lifted from a distance.

12. Scaffolding according to claim 2 in which the rear end of said upper slot is located in said vertical wall of the fork and said conical pin has a narrower end and a wider end and said narrower end is engaged inside said upper slot and said pivot has a thickness greater than the thickness of said upper slot and smaller than the thickness of said smaller slot and said wider end has a width greater than the length of said lower slot so that said pin is maintained prisoner in said fork and when in a rest position, the pin rests on the top of said transom and said pivot abuts against the lower face of said upper flange.

* * * * *